US011407535B2

(12) United States Patent
Oshima

(10) Patent No.: US 11,407,535 B2
(45) Date of Patent: Aug. 9, 2022

(54) PACKAGING SYSTEM

(71) Applicant: GENERAL PACKER Co., Ltd., Kitanagoya (JP)

(72) Inventor: Masashi Oshima, Kitanagoya (JP)

(73) Assignee: GENERAL PACKER CO., LTD., Kitanagoya (JP)

( * ) Notice: Subject to any disclaimer, the term of this patent is extended or adjusted under 35 U.S.C. 154(b) by 5 days.

(21) Appl. No.: 17/205,177

(22) Filed: Mar. 18, 2021

(65) Prior Publication Data

US 2021/0292017 A1 Sep. 23, 2021

(30) Foreign Application Priority Data

Mar. 18, 2020 (JP) ..... JP2020-047366

(51) Int. Cl.

| | |
|---|---|
| ***B65B 9/087*** | (2012.01) |
| ***B65B 31/02*** | (2006.01) |
| ***B65B 61/06*** | (2006.01) |
| ***B65B 7/02*** | (2006.01) |

(52) U.S. Cl.

CPC ..... *B65B 9/087* (2013.01); *B65B 7/02* (2013.01); *B65B 31/024* (2013.01); *B65B 61/06* (2013.01)

(58) Field of Classification Search

CPC ..... B65B 31/024; B65B 31/042; B65B 7/02; B65B 9/08; B65B 9/087; B65B 9/093; B65B 61/06

See application file for complete search history.

(56) References Cited

U.S. PATENT DOCUMENTS

| | | | | |
|---|---|---|---|---|
| 2,475,617 | A * | 7/1949 | Irmscher | B65B 29/028 53/550 |
| 2,649,674 | A * | 8/1953 | Bartelt | B65B 59/00 383/37 |
| 4,081,942 | A * | 4/1978 | Johnson | B65B 31/046 53/511 |
| 4,369,611 | A * | 1/1983 | Canfield | B29C 66/1122 53/DIG. 2 |
| 4,423,583 | A * | 1/1984 | Carey | B65B 43/465 53/384.1 |
| 6,050,061 | A * | 4/2000 | Todd | B65B 5/022 53/562 |
| 2005/0132670 | A1* | 6/2005 | Curran | B65B 9/08 53/469 |

(Continued)

FOREIGN PATENT DOCUMENTS

JP 2007-223673 A 9/2007

*Primary Examiner* — Thomas M Wittenschlaeger
(74) *Attorney, Agent, or Firm* — Muncy, Geissler, Olds & Lowe, P.C.

(57) ABSTRACT

A packaging system includes a bag feeding device for forming a packaging bag series having a continuous bag portion partitioned by a side seal portion from a long film and a bag mouth opening/closing device having a conveying path formed between a conveying device for pulling and conveying the packaging bag series with first grips and a guide rail parallel to the conveying path. The movers traveling on the guide rail has second grips for gripping the side seal portion. By controlling and adjusting the distance between one mover and the mover immediately after that, an upper end opening of the bag portion is opened or closed according to various processes of the packaging process.

6 Claims, 10 Drawing Sheets

(56) References Cited

U.S. PATENT DOCUMENTS

| | | | | |
|---|---|---|---|---|
| 2013/0152516 | A1* | 6/2013 | Sammons | B65B 7/02 53/562 |
| 2014/0331603 | A1* | 11/2014 | Takahashi | B65B 65/003 53/110 |
| 2018/0127132 | A1* | 5/2018 | Cybart | B65B 9/073 |
| 2019/0233152 | A1* | 8/2019 | Nakamoto | B65B 43/16 |

* cited by examiner

PACKAGING SYSTEM

CROSS-REFERENCE TO RELATED APPLICATIONS

This application is based upon and claims the benefit of priority from the prior Japanese Patent Application No. 2020-047366 filed on Mar. 18, 2020, the entire contents of which are incorporated herein by reference.

BACKGROUND

1. Technical Field

The present disclosure relates to a packaging system which opens an opening of a packaging bag to fill the packaging bag with an object to be packaged, replaces an atmosphere inside the packaging bag with a predetermined inert gas, and then seals the opening.

2. Related Art

In order that a packaged object may be prevented from deterioration due to oxidation, for example, a bagged product is known in which the inside of the bag is replaced with an inert gas such as nitrogen gas.

Japanese Patent Application Publication No. JP-A-2007-223673 discloses a filling and packaging machine which is configured to fold a long film in half while sandwiching chutes between the folded film halves at predetermined intervals, to heat-seal a gap between the chutes with a plurality of partition sealing devices attached to a rotating body in a radial direction thereby to form bag portions partitioned by partition seal portions, and to fill each bag portion with an object to be packaged, to replace an atmosphere inside each bag portion with a gas and to seal each bag portion while each bag portion is conveyed along a circumferential direction of the rotating body. The partition sealing devices also serve as grips for sandwiching the long film to be conveyed.

However, since the partition sealing devices of the filling and packaging machine described above are attached to the rotating body in the radial direction, it is difficult to adjust the widths between the partition sealing devices, and it is extremely difficult to switch the size of the packaging bag.

Furthermore, since the partition sealing devices that heat-seals the long film also serve as the grips, the wiring and structure of the filling and packaging apparatus become complicated. In addition, since the long film is required to be held for a while after heat sealing, the efficiencies of heat exhaust and film cooling may deteriorate.

Therefore, an object of the present disclosure is to provide a packaging system that can simplify the configuration of various devices responsible for the packaging process and the layout of these devices and can easily switch the size of the packaging bag.

SUMMARY

Therefore, an object of the present disclosure is to provide a packaging machine provided with a bottom-supporting device, capable of assisting each packaging process by adjusting vibration conditions, height adjustment, etc. in any step according to the product.

To achieve the object, the present disclosure provides a packaging system including a bag feeding device widthwise folding a long film unwound from a film roll to form a plurality of side seal portions for partitioning the folded long film at predetermined intervals along a length direction, the bag feeding device forming a plurality of bag portions between the adjacent side seal portions. The bag portions have respective upper end openings. The bag feeding device further forms a packaging bag series from the long film. The packaging bag series includes a plurality of successive bag portions. The packaging system further includes a conveying device for pulling and conveying the packaging bag series supplied from the bag feeding device along a conveying path to a counter-bag-feeding-device side with a first grip. The packaging system opens the upper end openings of the bag portions on the conveying path to fill each bag portion with an object to be packaged, replaces an atmosphere inside each bag portion with a predetermined inert gas, and then seals each bag portion. The packaging system further includes a guide rail parallel to the conveying path, and a plurality of movers respectively having second grips holding the side seal portions and being run on the guide rail. One of each mover and the guide rail is provided with a permanent magnet, and the other is provided with an electromagnet. The packaging system further includes a drive unit which moves the movers independently of each other on the guide rail in a linear drive manner, a mover position control unit which detects a position of each mover on the guide rail and stops each mover at a predetermined position, and a bag mouth opening/closing device which is configured to open or close an upper end opening of each bag portion by controlling stop positions of one of the movers and the mover immediately after said one of the movers to adjust a distance between the side seal portions of said one of the movers and the mover immediately after said one of the movers.

According to the above-described packaging system, the packaging bag series in which the bag portions partitioned by the side seal portions are continuous is formed from the long film. The guide rail is provided in parallel to the conveying path along which the packaging bag series is conveyed. The movers having respective grips holding the side seal portion are caused to run on the guide rail, and the position of the mover operated in the linear drive manner is detected. The bag mouth opening/closing device is configured to open or close the upper end opening of each bag portion by controlling the stop positions of one of the movers and another mover immediately after the mover to adjust the distance between the side seal portions of one of the movers and another mover immediately after the mover. Since the bag mouth opening/closing device controls the movers independently of each other, the upper end opening of each bag portion can be easily opened or closed, and the width of the bag portion can be easily changed along the conveying direction by adjusting the stop positions of one of the movers and another mover immediately after the mover.

The guide rail may have an orbit including a linear part facing the conveying path, and the orbit may be configured to be shiftable in the up-down direction relative to the conveying path. As a result, the height of the packaging bag series can be easily changed.

Therefore, since the packaging system is configured to easily change the width of the bag portion and the height of the packaging bag series, the packaging system can easily accommodate the size of the packaging bag for various bag products according to the application and the type of the object to be packaged.

Furthermore, the upper end opening of the bag portion is opened in order that the bag portion may be filled with the object to be packaged, and the atmosphere inside the bag portion is replaced with the predetermined inert gas. Then, the movers each of which has the grip sandwiching the side seal portion are caused to run on the guide rail. Furthermore, the distance between one mover stopping at the predetermined position on the conveying math and another mover immediately after the mover is adjusted according to each packaging process, and the upper end opening of the bag is opened or closed according to each packaging process. This can simplify the devices that configure the system and render the system easier to lay out since each of the devices responsible for the respective packaging processes performed along the conveying path and the bag mouth opening/closing device opening or closing the upper end opening of the bag portion are separated from each other.

DETAILED DESCRIPTION

Figure 1:
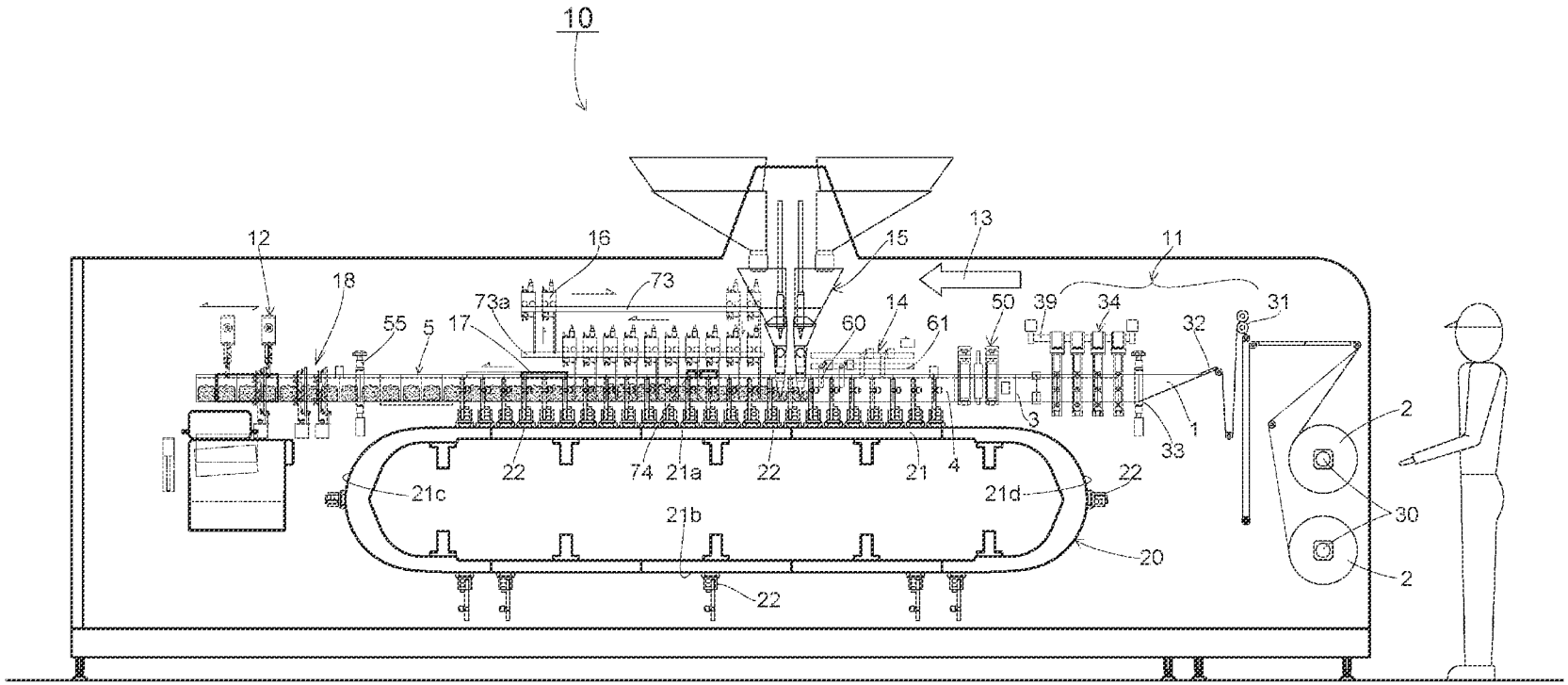
FIG. 1 is a layout diagram showing an outline of the configuration of the packaging system according to a first embodiment.
Figure 2:
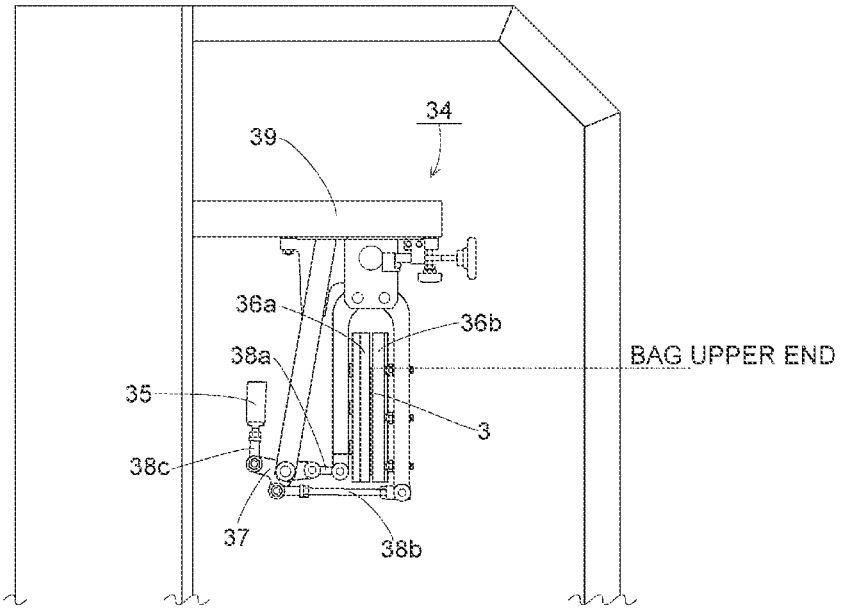
FIG. 2 is an explanatory view of the side surface of the device showing an outline of the configuration of the side seal unit of the packaging system according to the first embodiment.

An Example of the packaging system according to the present disclosure will be described with reference to the accompanying drawings. FIG. 1 is an explanatory view showing an outline of the configuration of the packaging system according to the embodiment, and FIG. 2 is an explanatory view of the side surface of the device showing an outline of a packaging process composing the packaging system according to the embodiment.

As shown in FIG. 1, the packaging system 10 includes a bag feeding device 11 for supplying packaging bags and a conveying device 12 for pulling and conveying the packaging bags, and a conveying path 13 for conveying the packaging bags is formed between the bag feeding device 11 and the conveying device 12. A bag mouth opening/closing device 20 for opening/closing a bag mouth of the packaging bag is arranged along the conveying path 13 configured in a linear line. A bag opening device 14, a filling device 15, and a gas replacement device 16 are arranged in order from the upstream side of the conveying path 13 in the section where the bag mouth opening/closing device 20 and the conveying path 13 are parallel to each other.

As shown in FIG. 1, the bag feeding device 11 includes a film roller 30, a tension roller 31, an auxiliary plate 32, a folding roller 33, and a side seal unit 34, and is arranged on a starting end side of the transport path 13. The film roller 30 rotatably supports a film roll 2 around which a long film 1 is wound. As a result, the long film 1 can be unwound from the film roll 2 pivotally supported by the film roller 30. The tension roller 31 applies a predetermined tension to the unwound film 1 to smooth wrinkles. The tension roller 31 is configured to feed the film 1 to an auxiliary plate 32 in a manner such that the film 1 is prevented from being displaced in a width direction thereof within a predetermined range.

Figure 9:
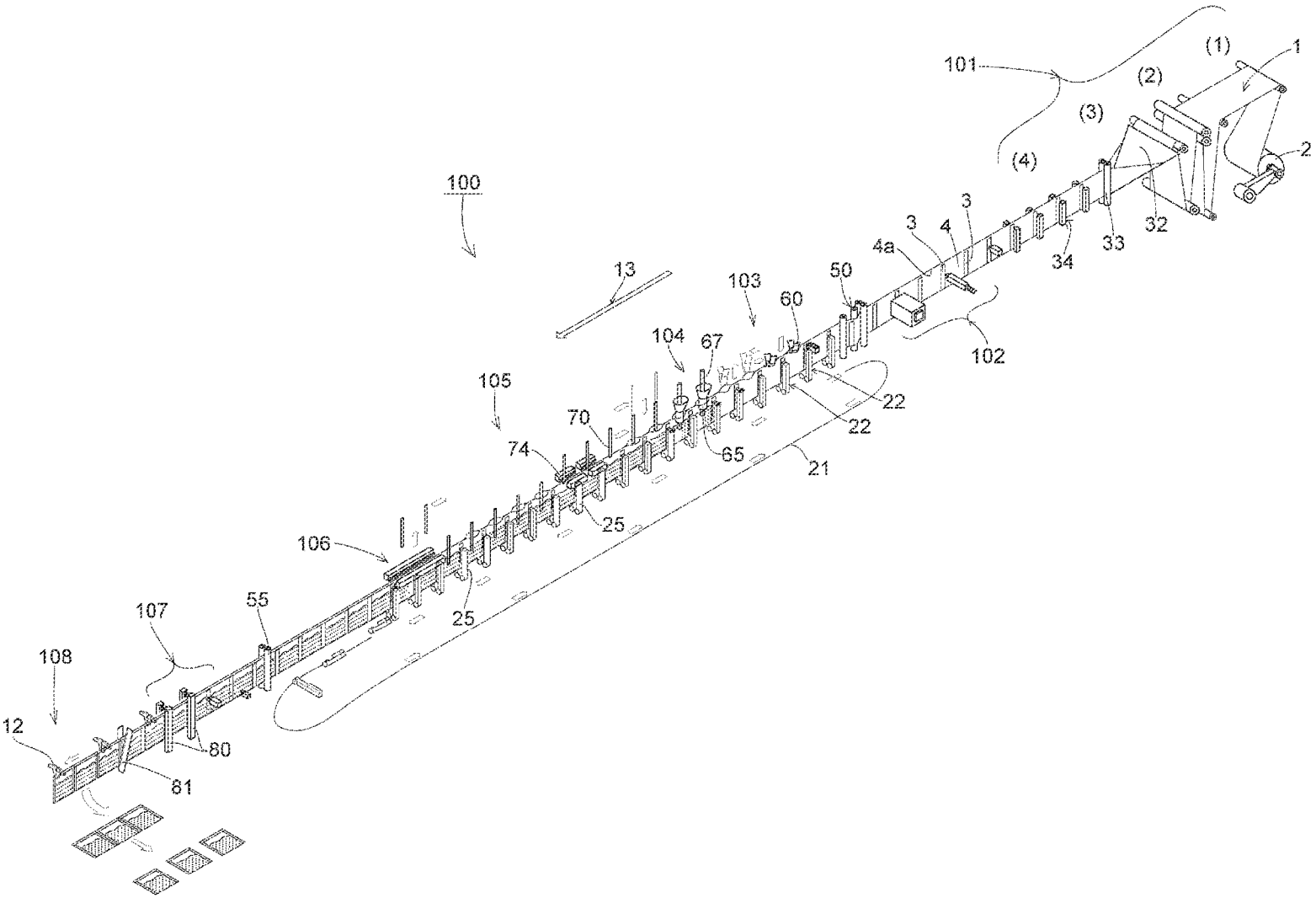
FIG. 9 is an explanatory diagram showing an outline of an overall configuration related to the packaging process of the packaging system according to the first embodiment.

As shown in FIG. 9, the auxiliary plate 32 is formed in a triangular shape, and has a bottom along the width direction of the film 1 and an apex facing downward between folding rollers 33 and diagonally downward with respect to a conveying direction of the film 1. As a result, when the film 1 drawn out along the lower surface of the auxiliary plate 32 passes between the pair of folding rollers 33 arranged to face each other, the center of the film 1 in the width direction is pushed down by the auxiliary plate 32, so that the film 1 is folded into two parts by a valley fold in the width direction.

As shown in FIG. 2, the side seal unit 34 has a cylinder 35, a pair of sealers 36*a*, 36*b*, and a link plate 37 connecting the sealers 36*a*, 36*b* and the cylinder 35 via rods 38*a*, 38*b*, 38*c*. The sealers 36*a* and 36*b* are configured so that when the rod 38*c* connected to the cylinder 35 is pushed down, the link plate 37 and the rod 38*a* pull one sealer 36*a*, and the link plate 37 and the rod 38*b* push the other sealer 36*b*, so that the sealers 36*a* and 36*b* opposite each other are opened. The sealers 36*a* and 36*b* are also configured so that when the link plate 37 and the rod 38*a* push one sealer 36*a*, and the link plate 37 and the rod 38*b* pull the other sealer 36*b*, so that the sealers 36*a* and 36*b* opposite each other are closed. The sealers 36*a* and 36*b* are configured to sandwich and heat-seal the film 1 having passed through the folding roller 33, at predetermined intervals along the conveying direction when the sealers 36*a* and 36*b* are closed. As a result, the side seal portions 3 for partitioning the long film 1 at predetermined intervals can be sequentially formed. The distance between one side seal unit 34 and another side seal unit 34 can be freely set. Consequently, the distance between one side seal unit 34 and another side seal unit 34 can be freely set. As a result, the side seal units 34 can be freely arranged at the predetermined equal intervals within a predetermined range regarding the length of the first base frame 39.

As described above, the film 1 is formed into the successive bag portions 4 respectively having upper end openings between the adjacent side seals 3 which are heat-sealed by the sealers 36*a* and 36*b*. That is, the bag feeding device 11 is configured to form a packaging bag series 5 having successive bag portions 4 via the side seal portions 3 from the film 1 and to feed the packaging bag series 5 to the conveying path 13.

Figure 3A:
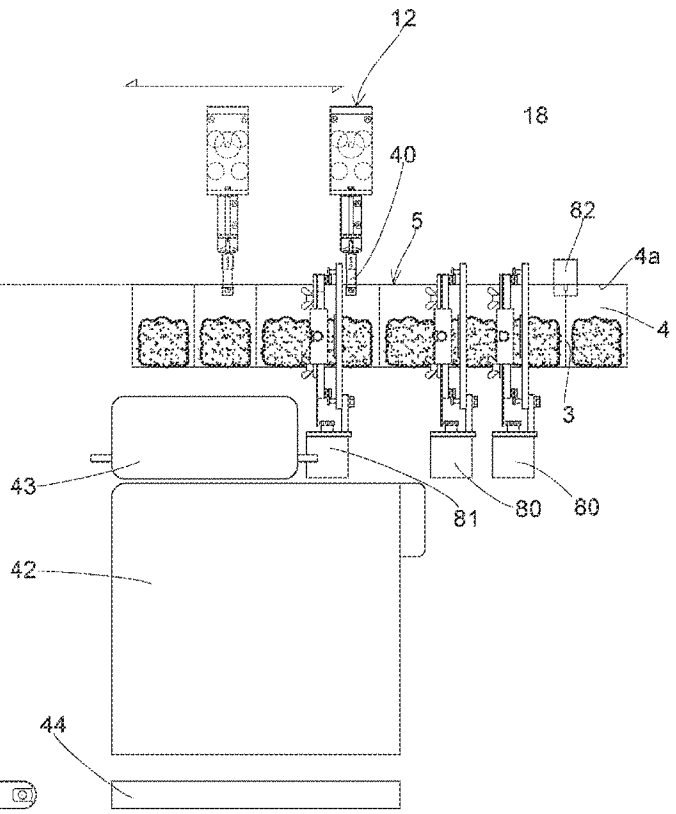
FIGS. 3A and 3B are explanatory views showing the front surface of the device and explanatory views showing the side surfaces of the device, respectively, showing the outline of the configurations of the transport device and the cutter device of the packaging system according to the first embodiment.
Figure 3B:
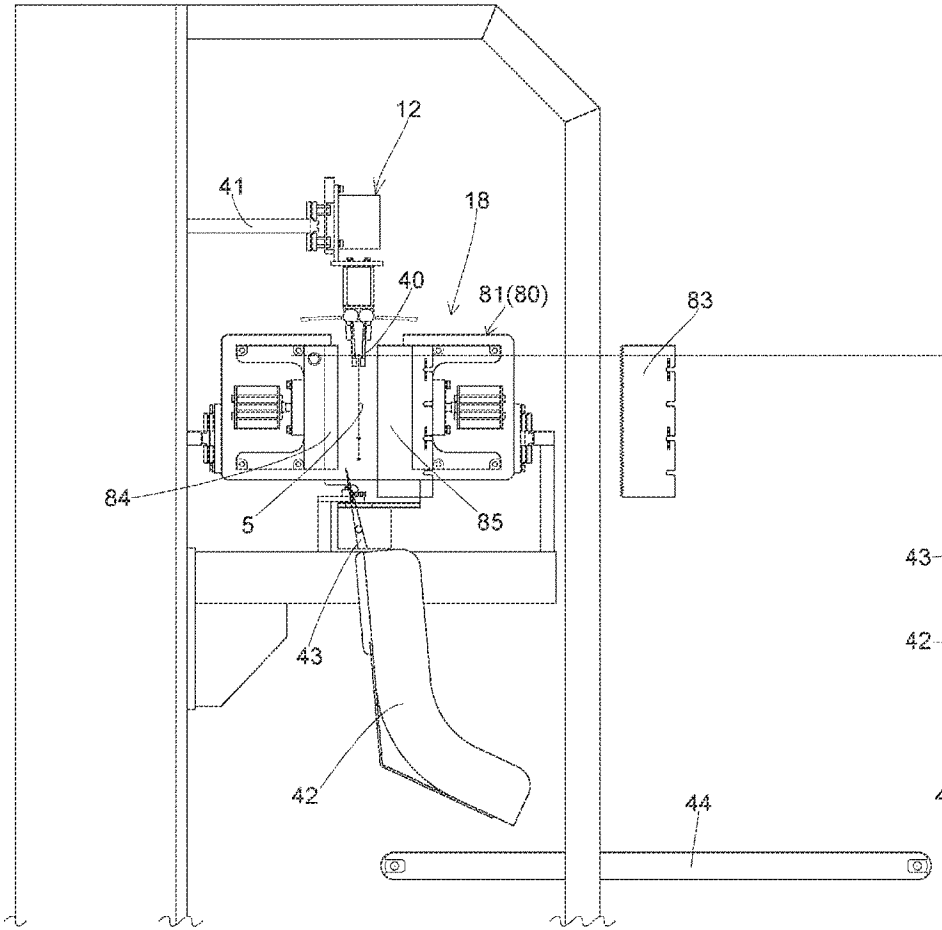

As shown in FIG. 1, the conveying device 12 that pulls and conveys the packaging bag series 5 is arranged on the terminal side of the conveying path 13. As shown in FIGS. 3A AND 3B, the conveying device 12 has a first grip 40 which can be opened and closed, and is attached to a second base frame 41 which is provided along the transport direction so as to be reciprocally movable by a servomotor (not shown). As shown in FIGS. 3A AND 3B, a carry-out slide 42 is installed below the terminal side of the second base frame 41. The carry-out slide 42 has a curved surface, and the packaging bag series 5 slides down on the carry-out slide 42. A sorter 43 is provided above the carry-out slide 42. The sorter 43 is pivotally supported so that the packaging bag series 5 can be sorted. A carry-out conveyor 44 is installed below the carry-out slide 42. The carry-out conveyor 44 carries out bag products formed by separating the bag portions 4 of the packaging bag series 5 by a predetermined number.

The first grip 40 is configured to be capable of gripping a portion of the packaging bag series 5 at a predetermined position near the upper end of the packaging bag series 5. When the first grip 40 grips the upper end of the distal bag portion 4 of the packaging bag series 5, the conveying device 12 is slid on the second base frame 41 toward the terminal side. As a result, the packaging bag series 5 is pulled and conveyed along the conveying direction, and a predetermined number of bag portions 4 are arranged above the sorter 43. Then, when a cutter device 81 which will be described later cuts the side seal portions 3 and the first grip 40 releases the packaging bag series 5, bag products including a predetermined number of bag portions 4 separated from the packaging bag series 5 drop on the sorter 43, sliding down the carry-out slide 42 to be carried out by the carry-out conveyor 44.

The conveying device 12 is configured to be slid on the second base frame 41 toward the start end side and return to the initial position after the first grip 40 has released the packaging bag series 5. As a result, the first grip 40 can grip the upper end of the distal bag portion 4 of the next packaging bag series 5. In the conveying device 12 in the embodiment, by adjusting the distance that the conveying device 12 is slid on the second base frame 41, the number of bag portions 4 contained in the bag product can be freely set from one packaging bag series to three packaging bag series. Instead of the above-described conveying device 12 in the embodiment, a take-up device with a drum for winding the packaging bag series 5 may be used to wind the packaging bag series 5 while pulling and conveying the packaging bag series 5 at the terminal side of the conveying path 13.

Furthermore, as shown in FIGS. 3A and 3B, a cutter device 18 is installed near the conveying device 12 for separating the side seal portions 3 of the packaging bag series 5 for each of a predetermined number of bag portions 4. A plurality of perforation cutter device 80 is also installed near the conveying device 12 for performing processing of a cutting line including dotted perforations on the side seal portions 3 so that the bag portion 4 can be easily separated.

As shown in FIG. 1, a bag mouth opening/closing device 20 is arranged in parallel along the carry-out path 13 in the vicinity of the carry-out path 13. The bag mouth opening/closing device 20 has a guide rail 21. The guide rail 21 is configured as an orbit including a pair of linear rail units 21*a* and 21*b* and a pair of semicircular rail units 21*c* and 21*d*. A plurality of movers 22 is arranged on the guide rail 21 so as to be freely movable along the orbit.

Here, one linear rail unit 21*a* arranged in the vicinity of the conveying path 13 is referred to as an outbound path in which the mover 22 travels along the conveying direction. One of two ends of the semicircular rail unit 21*c* is connected to an end of the outbound path 21*a*, and the other end of the semicircular rail unit 21*c* is connected to an inbound path including the other linear rail unit 21*b* parallel to the outbound path 21*a*. Furthermore, the other semicircular rail unit 21*d* connected to a start end of the outbound path 21*a* is connected to the terminal end of the inbound path 21*b*. As a result, the mover 22 operating on the outbound path 21*a* parallel to the conveying path 13 travels along the orbit with one semicircular rail unit 21*c*, the inbound path 21*b*, and the other semicircular rail unit 21*d* from the terminal end of the outbound path 21*a*, returning to the starting end of the outbound path 21*a*.

Figure 4A:
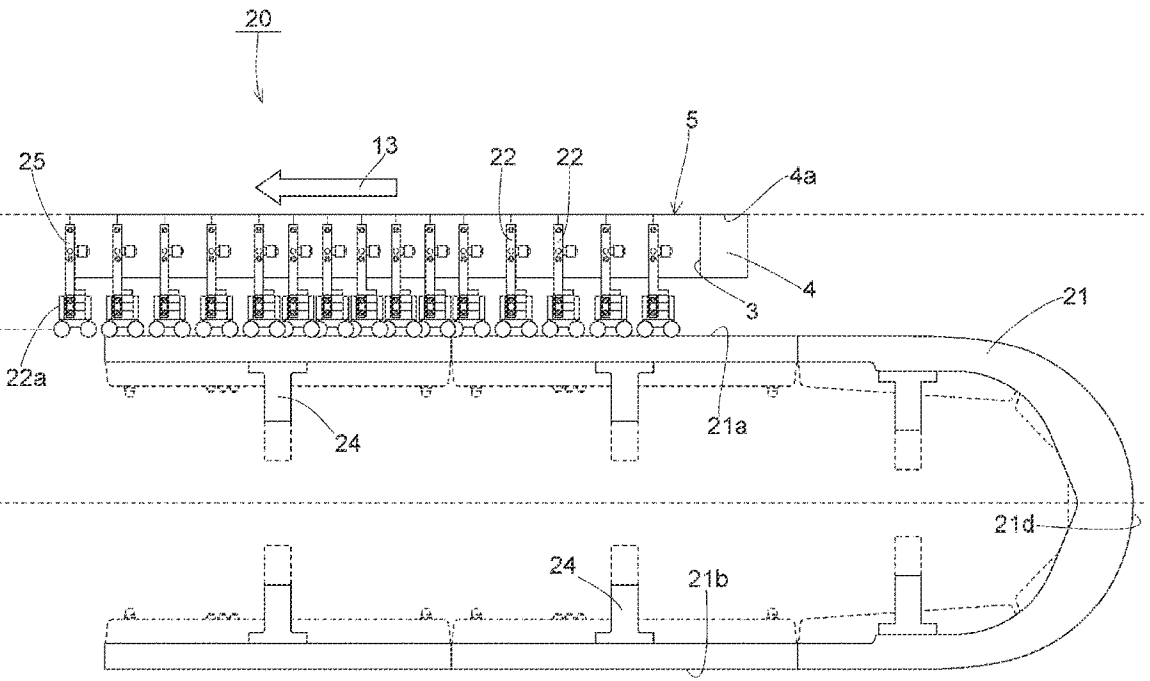
FIGS. 4A and 4B are respectively an explanatory view showing a part of the front surface and an explanatory view of the side surface of the device, showing an outline of the configuration of the bag mouth opening/closing device of the packaging system according to the first embodiment.
Figure 4B:
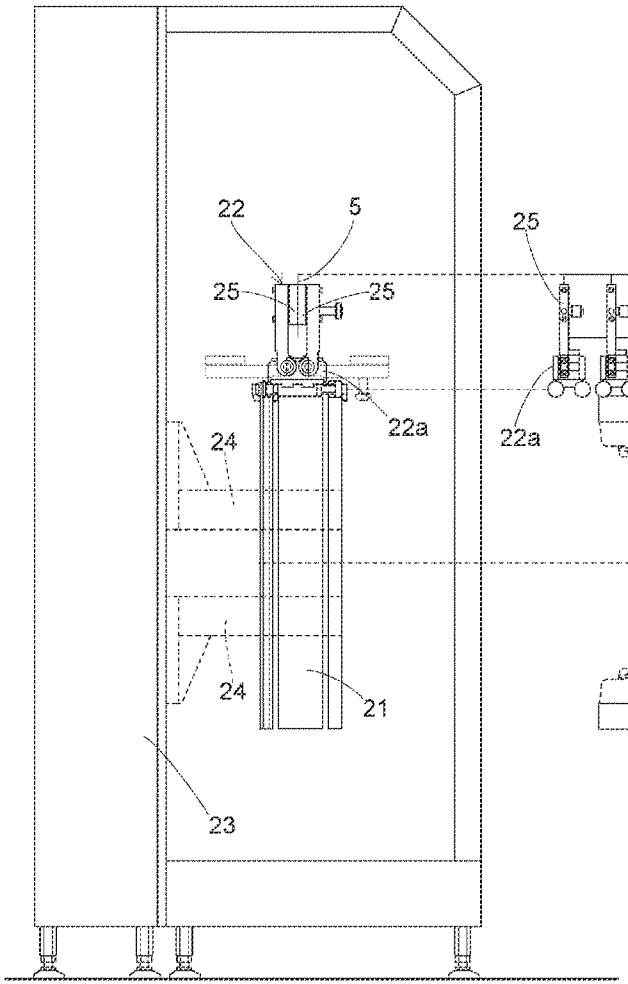

As shown in FIGS. 4A and 4B, the guide rail 21 is mounted to a base 23 via a bracket 24. The guide rail 21 is configured to be movable upward or downward with respect to the bracket 24. As a result, the guide rail 21 is configured to move upward or downward so as to go away from or come close to the conveying path 13. Therefore, even if the width of the film 1 formed into the packaging bag series 5 is changed to increase or decrease the height of the packaging bag series 5, the guide rail 21 is moved in the up-down direction. The position of each mover 22 can easily correspond to that of the packaging bag series 5 by adjusting the movement.

Although the guide rail 21 is configured to be movable upward or downward in the embodiment, but the present disclosure should not be limited to this configuration. The bracket 24 may be configured to be movable upward or downward with respect to the base 23 so that the guide rail 21 goes away from or comes close to the conveying path 13.

As shown in FIGS. 4A and 4B, each mover 22 has a second grips 25 that can be opened and closed. The second grips 25 are configured to be capable of gripping the side seal portions 3 of the packaging bag series 5 conveyed on the conveying path 13 or on the outbound path 21*a*. As shown in FIG. 1, the second grips 25, after having released the packaging bag series 5 at the end of the outbound path 21*a*, are caused to oppositely fall down on one semicircular rail unit 21*c* into the open state. The second grips 25 are configured to start up at the starting end of the outward path 21*a* thereafter, stand up relative to each other, and grip the side seal portions 3 of the packaging bag series 5.

The bag mouth opening/closing device 20 has driving means for causing the movers 22 to travel along the guide rail 21 and control means for controlling the driving means. The drive means is configured to linearly drive each mover 22 independently. In the linear drive, an electromagnet is attached to one of the facing surfaces of the guide rail 21 and the mover 22, and a permanent magnet is attached to the other. The polarity of the electromagnet is successively inverted by a predetermined switching operation. In this case, the mover 22 is repelled when the electromagnet has the same magnetic pole as the opposed permanent magnet. When the electromagnet has the opposite pole to the opposed permanent magnet, the mover 22 is driven along the guide rail 21 while being pulled.

In the embodiment, a plurality of electromagnets are laid along the entire circumference of the orbit along the guide rail 21, and permanent magnets are attached to the bottom surface of the base 22*a* of the mover. The mover 22 can be freely driven on the orbit by switching the magnetic poles of the electromagnet on the guide rail 21.

The control means has a sensor (not shown) and is configured to control the drive means to stop the mover 22 at a predetermined position. The sensor is configured to be capable of detecting the position of each mover 22 arranged on the guide rail 21. Based on the detected position of the mover 22, the control means controls whether the mover 22 is stopped at a predetermined position on the guide rail 21 or moved on the guide rail 21 by the driving means. Thereby, the stop position of the one mover 22 and the stop position of the mover 22 immediately after that along the conveying direction can be controlled, and the distance between the one mover 22 and the mover 22 immediately after that can be controlled. That is, since the second grips 25 of the mover 22 grip the side seal portion 3 of the packaging bag series 5, the distance between one side seal portion 3 and the side seal portion 3 immediately after that along the conveying direction can be adjusted.

As described above, the conveying path 13 of the packaging bag series 5 is formed between the bag feeding device 11 and the conveying device 12. A starting end side packaging bag feeding device 50 is arranged on the starting end side of the conveying path 13 and on the downstream side of the bag feeding device 11.

Figure 5B:
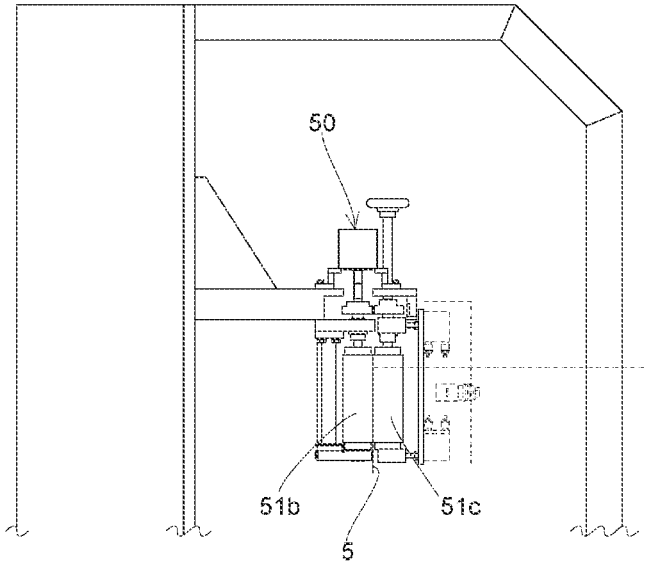
FIGS. 5A and 5B are respectively an explanatory view of the front surface of the device and an explanatory view of the side surface of the device, showing an outline of the configuration of the starting end side packaging bag feeding device of the packaging system according to the first embodiment.
Figure 5A:
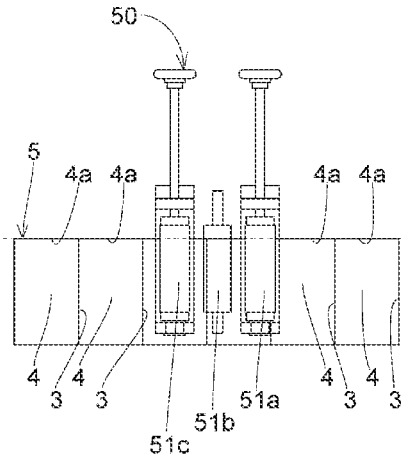

As shown in FIG. 5, the starting end side packaging bag feeding device 50 has three rollers 51*a*, 51*b*, and 51*c* arranged alternately with respect to the conveying direction. As shown in FIG. 5, the packaging bag series 5 is configured to pass between the rollers 51*a*, 51*b*, and 51*c* arranged alternately. By moving the rollers 51*a*, 51*b* and 51*c* so that the rollers 51*a*, 51*b* and 51*c* approach the same straight line along the conveying direction, the packaging bag series 5 is strongly tensioned, and by separating the rollers 51*a*, 51*b* and 51*c* from the same straight line along the conveying direction, the tension applied to the packaging bag series 5 can be relaxed. By adjusting the position of the roller in this way, an appropriate tension is applied to the packaging bag series 5, and by rotating the roller, the packaging bag series 5 can be fed along the conveying direction.

On the other hand, a terminal side packaging bag feeding device 55 is arranged on the terminal side of the conveying path 13 upstream of the conveying device 12.

As shown in FIG. 1, the terminal side packaging bag feeding device 55 includes a pair of rollers that sandwich the packaging bag series 5 from both sides along the conveying direction. Furthermore, since the rollers sandwich the packaging bag series 5, the packaging bag series 5 is stretched between the terminal side packaging bag feeding device 55 and the starting end side packaging bag feeding device 50. In cooperation with the starting end side packaging bag feeding device 50, the terminal side packaging bag feeding device 55 can held the packaging bag series 5 stretched therebetween.

As shown in FIG. 1 or FIGS. 4A and 4B, the side seal portions 3 formed between the bag portions 4 of the packaging bag series 5 conveyed along the conveying direction is gripped by the second grips 25. By adjusting the distance between the movers 22 related to the second grips 25, the packaging bag series 5 is configured so that the upper end openings 4*a* of the bag portions 4 are opened or closed at predetermined portions on the conveying path 13 when the bag portions 4 of the packaging bag series 5 are moved from the starting end side of the conveying path 13 toward the terminal side.

Here, the predetermined portions on the transport path 13 refer to portions where the packaging process for forming bag products based on the packaging bag series 5, and where various devices related to the packaging process are installed. These various devices include a bag opening device 14, a filling device 15, a gas replacement device 16, a sealing device 17, and a cutter device 13 from the upstream side of the conveying path 13.

As shown in FIG. 1, the bag opening device 14 has a guide unit that can move in pairs along the transport path 13. As a result, the bag opening device 14 can open the upper end openings 4*a* of the bag portions 4 of the packaging bag series 5 two by two. The guide unit has a pair of guide spatula 60 whose tip portions are formed so as to be attachable/detachable. The upper end opening 4*a* of the bag portion 4 can be opened by separating the guide spatula 60 inserted into the upper end opening 4*a* of the bag portion 4 so as to be opposite to each other. In order that the upper end opening 4*a* may be easily opened in opening the upper end opening 4*a*, the distance between one mover 22 that moves on the outbound path 21*a* along the conveying direction and the mover 22 immediately after that is determined to be rendered shorter than the distance immediately after the packaging bag series 5 has been fed from the bag feeding device 11 to the conveying path 13.

The guide unit has a pair of guide spatula 60 whose tip portions are formed so as to be attachable/detachable. The upper end opening 4*a* of the bag portion 4 can be opened by separating the guide spatula 60 inserted into the upper end opening 4*a* of the bag portion 4 so as to be opposite to each other. In order that the upper end opening 4*a* may be easily opened in opening the upper end opening 4*a*, the distance between one mover 22 that moves on the outbound path 21*a* along the conveying direction and the mover 22 immediately after that in a part parallel to the bag opening/closing device 14 is determined to be rendered shorter than the distance immediately after the packaging bag series 5 has been fed from the bag feeding device 11 to the conveying path 13.

As shown in FIG. 1, the bag opening device 14 has a predetermined first circulation path 61 including an opening path 61*a* along the conveying path 13. The first circulation path 61 includes a path for lowering the guide unit from the initial position on the upstream side along the conveying direction and inserting the guide spatula 60 into the upper end opening 4*a* of the bag portion 4, an opening path 61*a* that reciprocally separates the tip of the guide spatula while moving the guide spatula 60 along the conveying direction, and a path for raising the guide unit at the end of the opening path 61*a*, pulling out the guide spatula 60 from the upper end opening 4*a*, and returning the guide unit to the initial position. By moving the guide unit in pairs, the bag portions 4 of the packaging bag series 5 can be opened by two. In FIG. 1 according to the present embodiment, four guide units for two sets are shown, but the present disclosure should not be limited to this, and six to eight guide units may be installed. As a result, the guide unit can be circulated along the first circulation path 61 to efficiently perform the opening process of opening the upper end opening 4*a* of the bag portion 4.

As shown in FIG. 1, two filling devices 15 are arranged side by side in parallel with the conveying path 13, and are formed so as to fill the two bag portions 4 that have moved along the conveying direction with the object to be packaged. In order that the upper end opening 4*a* may be opened to a large extent in the filling of the bag portion 4 with the object to be packaged, the distance between one mover 22 moving on the outbound path 21*a* along the conveying direction and the mover 22 immediately after that is determined to be shorter at a location parallel to the filling device 15 than at a location parallel to the bag opening device 14. As a result, the upper end opening 4*a* can be greatly opened.

Figure 6:
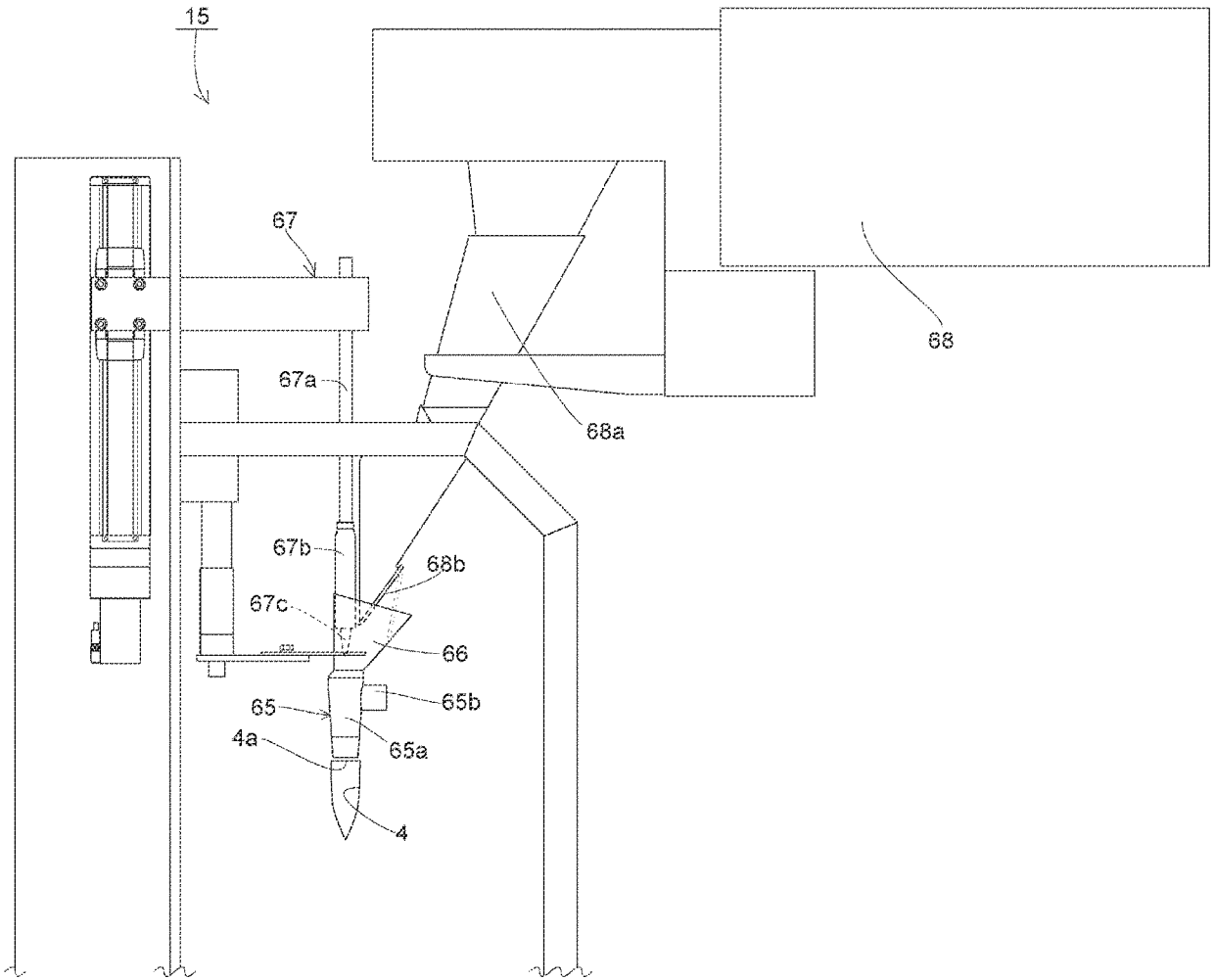
FIG. 6 is an explanatory view of the side surface of the device showing the outline of the configuration of the filling device of the packaging system according to the first embodiment.

As shown in FIG. 6, the filling device 15 includes a filling nozzle 65 for filling the bag portion 4 with an object to be packaged, a filling jaw 66 for supplying the object to be packaged to the filling nozzle 65, and a degassing unit 67 for degassing the bag portion 4 filled with the object. The packaged object according to the present embodiment is, for example, a powder or granular material such as wheat flour or pet food, but is not limited to this, and may be, for example, a bonito flakes.

As shown in FIG. 6, a stocker 68 in which the objects to be packaged are stored is arranged above the filling device 15. The stocker 68 has a long nozzle 68*a* for pouring the object to be packaged into the filling device. The long nozzle 68*a* is formed by connecting a plurality of funnels whose diameters gradually decrease from the upper end to the lower end. A shutter 68*b* is attached to a tip of the long nozzle 68*a* so as to be openable and closable, and a filling funnel 65 is arranged below the tip. As a result, the object to be packaged supplied from the stocker 68 above the long nozzle 68*a* slides down inside the long nozzle 68*a* and is accumulated at the tip end portion.

The shutter 68*b* is formed so as to open and close at a predetermined cycle synchronized with the movement of the bag portion 4 along the conveying direction. As a result, a predetermined amount of the object to be packaged to be stored in the bag portion 4 can be supplied from the stocker 68 to the filling funnel 65 via the long nozzle 68*a*.

As shown in FIG. 6, the filling funnel 66 is formed in a manner such that a diameter thereof is gradually reduced from an upper end to a lower end. As a result, the object to be packaged that has slipped off the inner surface can be supplied to the filling nozzle 65. The lower end of the filling funnel 66 is connected to the upper end of the filling nozzle 65.

Figure 7:
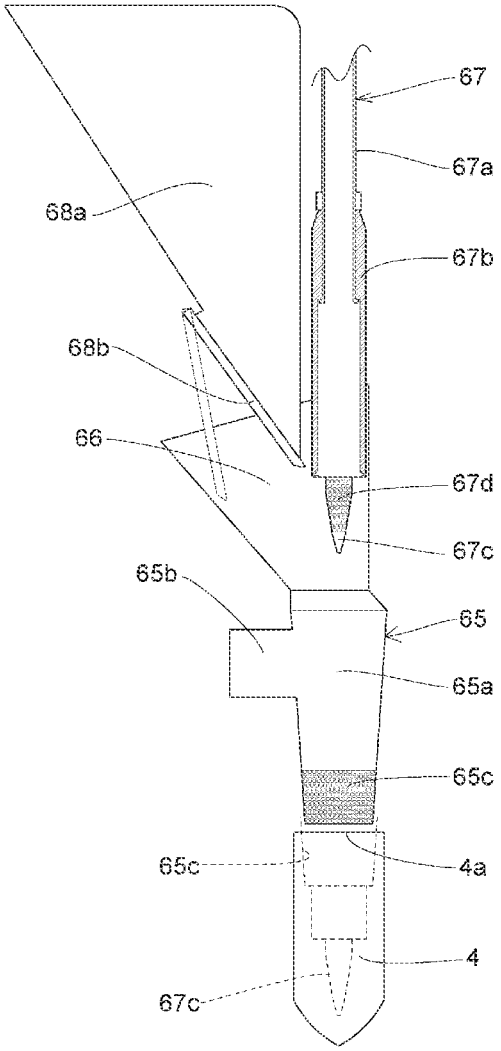
FIG. 7 is a partially enlarged cross-sectional view showing an outline of the configuration in the vicinity of the filling nozzle of the packaging system according to the first embodiment.

As shown in FIG. 6, the filling nozzle 65 has a tubular nozzle body 65*a* connected to the filling funnel 66 and arranged in the longitudinal direction. The nozzle body 65*a* has a tubular sleeve portion 65*b* communicating with the side surface portion, and a plurality of small holes 66*c* are formed in the vicinity of the lower end portion as shown in FIG. 7. The filling funnel 66 and the filling nozzle 65 are configured to be movable upward and downward as shown in FIG. 6. As a result, when the bag portion 4 is filled with the object to be packaged, the vicinity of the lower end portion of the nozzle body 65*a* can be inserted into the bag portion 4 as shown by the dotted line in FIG. 7. One of two ends of a degassing hose (not shown) is connected to the tip of the sleeve portion 65*b*, and the other end of the degassing hose is connected to a degassing pump (not shown). As a result, a degassing process of degassing the inside of the filling nozzle 65 and the inside of the bag portion 4 through the sleeve portion 65*b* can be performed. The degassing process is performed together with a degassing process by the degassing unit 67 described below.

The degassing unit 67 includes a degassing pipe and a degassing pump (not shown). As shown in FIG. 7, the degassing pipe is composed of an upper pipe 67*a* and a lower pipe 67*b* communicating with the upper pipe 67*a*, and a tapered pipe tip portion 67*c* is formed at the lower end of the lower pipe 67*b*. A plurality of small holes 67*d* is formed in the vicinity of the tip of the pipe tip 67*c*, and the pipe tip 67*c* is formed in a substantially conical shape with a rounded top. As shown in FIG. 6, the degassing unit 67 is configured such that the degassing pipe can move upward and downward. As a result, when the bag portion 4 is filled with the packaged object, the pipe tip portion 67*c* of the degassing pipe is passed through the lower end edge portion of the nozzle body 65*a* of the filling nozzle 65, and as shown by the dotted line in FIG. 7, the pipe tip portion 67*c* can be pushed to the vicinity of the bottom in the bag portion 4. That is, the degassing unit 67 is configured such that, the pipe tip portion 67*c* having a plurality of small holes 67*d* is arranged near the bottom in the bag portion 4, and the lower end of the nozzle body 65*a* having a plurality of small holes 65*c* near the upper end edge of the bag portion 4 is arranged near the upper end of the bag portion 4. Furthermore, the object filling the bag portion 4 can be pushed with the pipe tip portion 67*c*.

Similar to the sleeve portion 65*b*, one of two ends of a degassing hose (not shown) is connected to the upper end of the upper pipe 67*a*, and the other end of the degassing hose is connected to the degassing pump. As a result, the degassing process of degassing the inside of the bag portion 4 through the degassing pipe 67 can be performed.

As shown in FIG. 1, a pair of gas replacement devices 16 are arranged so as to operate in pairs on the downstream side of the filling device 15 along the conveying direction. When the inside of the bag portion 4 is gas-replaced by the gas replacement device 16, the upper end opening 4*a* is narrowed down to prevent the inert gas from leaking, and the mover 22 moves on the outbound path 21*a* along the conveying direction. Immediately after that, the distance between the movers 22 is longer in the portion parallel to the gas replacement device 16 than in the portion parallel to the filling device 15, and the upper end opening 4*a* is configured to be slightly closed.

Figure 8:
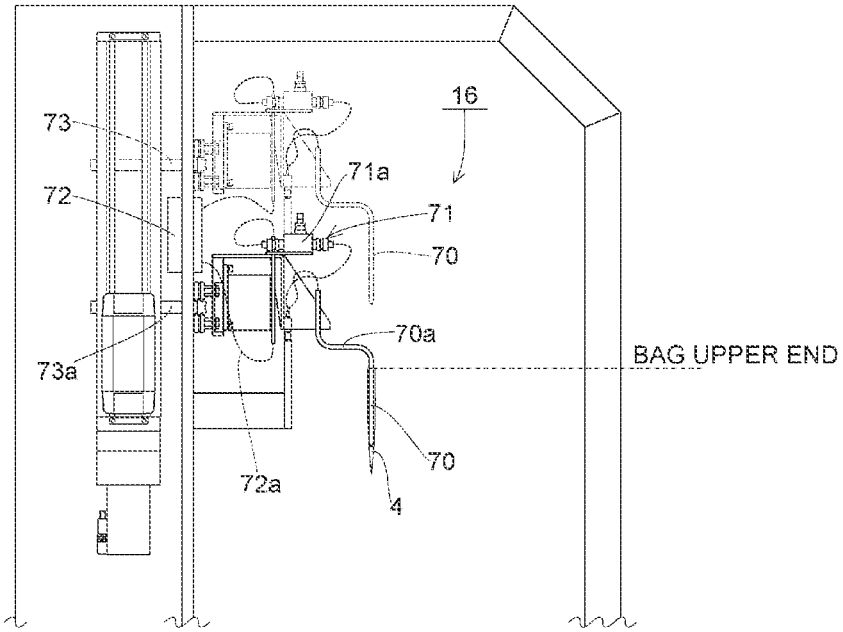
FIG. 8 is an explanatory view of the side surface of the device, showing the outline of the configuration of the gas replacement device of the packaging system according to the first embodiment.

Each gas replacement device 16 has a gas nozzle 70 shown in FIG. 8 and a temporary seal unit 74. The gas nozzle 70 has a distal end that is formed so as to be insertable into the bag portion and a proximal end to which one of two ends of the gas pipe 70*a* is connected. As a result, the gas nozzle 70 can fill the bag portion with the inert gas and perform gas replacement that fills the degassed bag portion with the inert gas. The other end of the gas pipe 70*a* is connected to a gas supply unit 71 as shown in FIG. 8.

The gas supply unit 71 includes a gas valve 71*a* installed in each of the gas replacement devices 16, and a gas supply source 72 connected to the gas valve 71*a* by a flexible tube 72*a*. The gas valve 71*a* has a check valve (not shown). The gas supply source 72 is installed near the center of the second circulation path 73 in which each gas replacement device 16 is circulated, and is formed to be rotatable in synchronization with the circulation movement of each gas replacement device 16. By supplying the inert gas from the gas supply source 72 at a predetermined pressure, the inert gas can be supplied to each gas replacement device 16 through the gas valve 71*a*. The inert gas according to this embodiment is nitrogen gas or carbon dioxide gas, but the present disclosure should not be limited to the nitrogen gas or carbon dioxide gas. Any inert gas capable of preventing oxidation of the packaged object can be appropriately selected.

A second circulation path 73 includes a replacement path 73*a* parallel to the conveying path 13, and is formed such that the gas replacement devices 16 are movable thereon in pairs. The second circulation path 73 includes a path in which the gas nozzle 70 is inserted into the bag portion 4 and set from the initial position of each gas replacement device 16 as each gas replacement device 16 descends, a replacement path 73*a* whose start end is connected to the aforementioned path and in which the inert gas is sent to the bag portion 4, and another path along which each gas replacement device 16 is raised from the end of the replacement path 73*a* to be returned to the initial position.

As shown in FIG. 1, a plurality of sets of gas replacement devices 16 is circulated and moved on the second circulation path 73 in pairs. By using the plurality of gas replacement devices 16 in this way, the air in the bag portion 4 can be replaced with the inert gas over a sufficient period of time, and the gas replacement efficiency in the bag portions 4 can be improved. Each pair of gas replacement devices 16 are configured to move along the replacement path 73*a* in synchronization with the movement of the bag portion 4 along the conveying direction. As a result, the gas nozzle 70 included in each gas replacement device 16 can replace the gas in the bag portion 4 in a predetermined time in accordance with the movement of the bag portion 4.

As shown in FIG. 1, a temporary seal unit 74 is arranged on the start end side of the replacement path 73*a*. The temporary seal unit 74 is configured to heat-seal both ends of the upper end opening 4*a* of each bag portion 4 from the front and rear side seal portions 3 along the conveying direction in a predetermined range. Thereby, the upper end opening 4*a* can be narrowed. Therefore, in the filling device 15 provided on the upstream side of each gas replacement device 16, extra air can be prevented from entering through the upper end opening 4*a* after the inside of each bag portion 4 has been degassed. Furthermore, an excess inert gas can be prevented from leaking from the upper end opening 4*a* in the gas replacement process.

As shown in FIG. 1, a sealing device 17 is arranged near the end of the replacement path 73*a*. The sealing device 17 has a pair of sealers which are arranged so as to face each other, and is configured such that the upper end edge of the packaging bag series 5 can be heat-sealed. As a result, the sealing device 17 is included in the upper end edge portion of the packaging bag series 5, and the temporarily sealed upper end opening 4*a* can be heat-sealed, so that the bag portion 4 can be sealed. In order that wrinkles may be prevented from being formed and causing a sealing failure when the sealing device 17 heat-seals the upper end edge of the packaging bag continuous packaging 5, the distance between one mover 22 moving on the outbound path 21*a* along the conveying direction and the mover 22 immediately after that is set to be longer than the portion where the gas replacement device 16 is parallel to the conveying path 13 so that at least the upper end edge of the packaging bag continuous packaging 5 can be stretched at the portion where the sealing device 17 and the conveying path 13 are parallel to each other. After the sealing device 17 has heat-sealed the upper end edge of the packaging bag series 5, the second grip 25 of the mover 22 expands in opposition to each other, and the side sealing portion 3 is separated, as shown in FIG. 1. The packaging bag series 5 released from the mover 22 is pulled by the conveying device 12 along the conveying direction.

As shown in FIG. 1, a cutter device 18 is arranged on the downstream side of the sealing device 17 and on the upstream side of the conveying device 12 along the conveying direction. As shown in FIGS. 3A AND 3B, the cutter device 18 includes a perforation cutter device 80 and a cutting cutter device 81. As shown in FIGS. 3A AND 3B, a mark sensor 82 for detecting the side seal portion 3 of the packaging bag series 5 is provided on the upstream side of the cutter device 18 along the conveying direction. By measuring the distance between the side seal portions 3 by the mark sensor 82, the cutter device 18 can perforate or cut the side seal portion 3.

As shown in FIGS. 3A AND 3B, the perforation cutter device 80 has a saw-toothed perforated blade portion 83 and a blade contact portion 84 arranged to face the perforated blade portion 83. The perforated blade portion 83 and the blade contact portion 84 are configured to be detachable from each other with respect to the side seal portion 3 of the packaging bag series 5 that moves along the conveying direction. When the perforated blade portion 83 and the blade contact portion 84 come into contact with each other with the side seal portion 3 being sandwiched therebetween, a dotted line perforation can be formed in the side seal portion 3. As a result, the bag portions 4 can be easily separated from the packaging bag series 5 one by one. Furthermore, when the perforation cutter device 80 forms a perforation in the side seal portion 3, the heat seal is formed. A notch may be made in the side seal portion 3 slightly below the upper end edge portion of the packaged bag series 5. Thereby, the notch can be a trigger to break the side seal portion 3 in opening the bag when the bag portions 4 are separated one by one.

As shown in FIGS. 3A AND 3B, the perforation cutter device 80 operates as a set of two units, and is configured to simultaneously provide perforations to the front and rear side seal portions 3 of each bag portion 4 along the conveying direction.

As shown in FIGS. 3A AMD 3B, the cutting cutter device 81 has a straight-edged cutting blade portion 83 and a blade contact portion 64 arranged to face the cutting blade portion 85. The cutting blade portion 85 and the blade contact portion 84 are configured to be in contact with each other with respect to the side seal portion 3 of the packaging bag series 5 that moves along the conveying direction. When the cutting blade portion 85 and the blade contact portion 84 come into contact with each other with the side seal portion 3 being sandwiched therebetween, the side seal portion 3 can be cut. Thereby, the bag product having a predetermined number of bag portions 4 can be separated and formed from the continuous packaging bag series 5. The formed bag product are caused to fall downward and slide down the above-mentioned carry-out slide 42, and is carried out from the carry-out conveyor 44.

The packaging process of the packaging system 10 having the above-described configuration will be described below with reference to the attached drawings. FIG. 9 is an explanatory diagram showing an outline of the configuration of the packaging process by the packaging system 10 according to the present embodiment, and FIG. 10 is an explanatory diagram showing the outline of each processing process of the packaging process by the packaging system 10 according to the present embodiment.

As shown in FIG. 9, the packaging system 10 has a packaging process 100 in which a plurality of processing steps performed on the long film 1 conveyed from upstream to downstream along the conveying direction are combined. As shown in FIG. 10, the packaging process 100 includes a bag feeding step 101, a printing/inspection step 102, a bag opening step 103, a filling step 104, a gas replacement step 105, a sealing step 106, a perforation step 107, and a cutting step 108.

Figure 10:
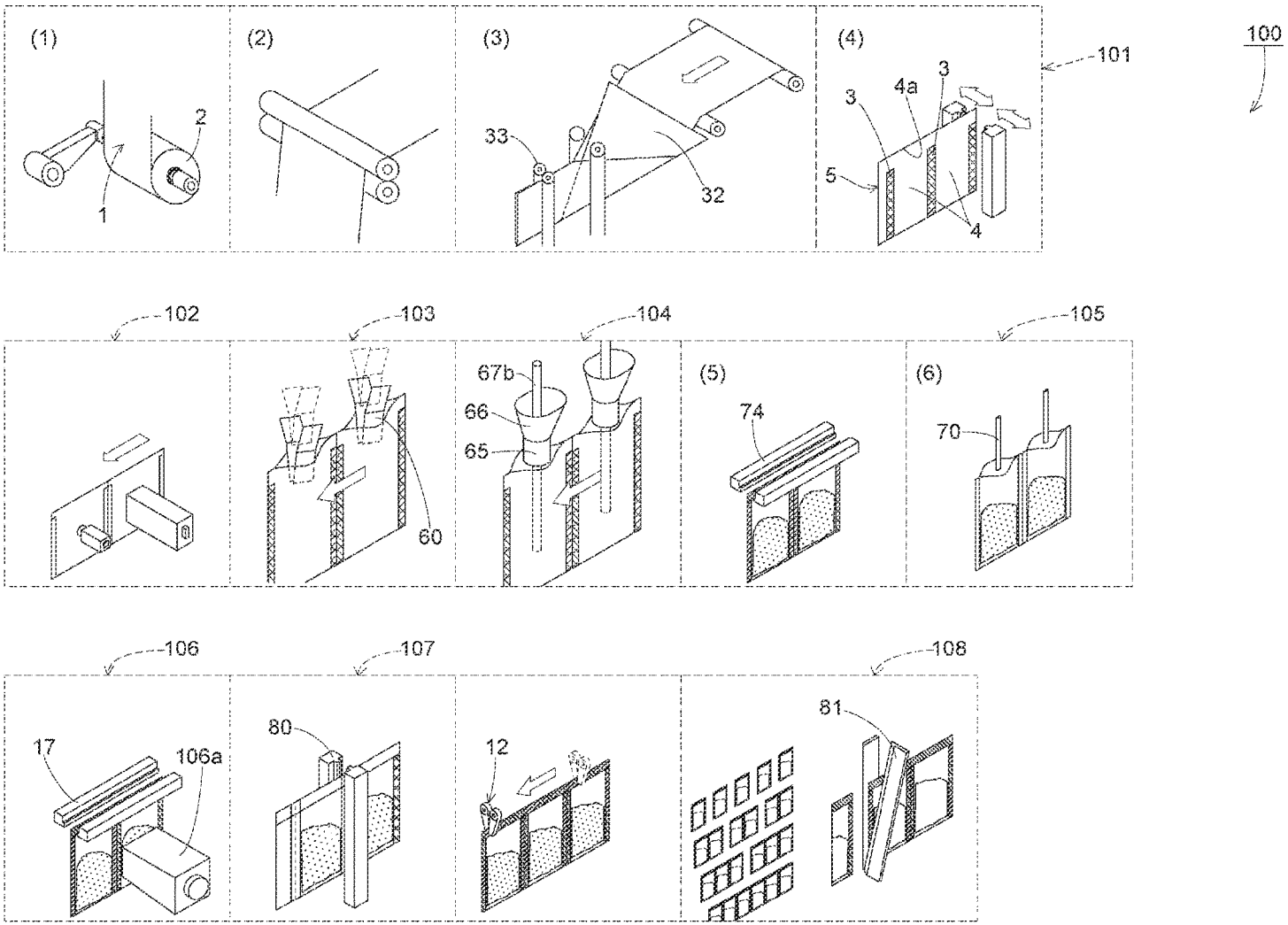
FIG. 10 is an explanatory diagram showing an outline of the configuration of each process composing the packaging process of the packaging system according to the first embodiment.

The bag feeding step 101 includes the processing steps (1) to (5) of FIGS. 9 and 10. The step (1) is a feeding step in which the film 1 is fed from the film roll 2. In the step (2), a process of adjusting whether or not the film is correctly fed in the conveying direction is performed. The subsequent step (3) is a folding step of folding the film 1 in half by valley folding in the width direction.

The folding step is performed using a triangular auxiliary plate 32 having a bottom along the width direction of the film 1 and a downwardly pointing apex between the folding rollers 33. When the film 1 conveyed along the lower surface of the auxiliary plate 32 passes between the folding roller pairs 33 arranged on the downstream side of the apex of the auxiliary plate 32, the film 1 is folded in two in the width direction.

In step (4) following the folding step, the folded film 1 is partitioned at predetermined intervals to be formed into the side seal portion 3, and step (4) is also a side seal step of forming the bag portions 4 between the side seal portions 3. After the side seal unit 34 sandwiches the film 1 and heat-seals the film 1, the film 1 on which the side seal portion 2 is formed is released from the sealers 36*a* and 36*b* of the side seal unit 34 and cooled.

In this way, the bag feeding step 101 forms a packaging bag series 5 having continuous bag portions 4 partitioned by the side seal portion 3 from the film 1.

The printing/inspection step 102 includes a step of printing, for example, a manufacturing date, an expiration date, an expiration date, etc. on the bag portion 4 of the packaging bag series 5, and a step of inspecting good/bad of the side seal portion 3. The packaging bag series 5 that has passed through the printing/inspection step 102 is sent to the conveying path 13 by the start end side packaging bag feeding device 50.

As shown in FIG. 1, the conveying path 13 is configured to join the guide rail 21 of the bag opening/closing device 20 on the downstream side of the start end side packaging bag feeding device 50. As shown in FIG. 9, since the opposite movers 22 sandwich the side seal portions 3 of the packaged bag series 5 to be sent out, the side seal portions 3 of packaging bag series 5 that has passed through the starting end side packaging bag feeding device 50 are sandwiched by the second grips 25 included in the movers 22. In subsequent steps, by adjusting the distance between one mover 22 and the mover 22 immediately after that, the upper end opening 4*a* of the bag portion 4 is opened or closed. Even when the upper end opening 4*a* is open, the degree of opening of the upper end opening 4*a* is adjusted according to the processing step.

As shown in FIGS. 9 and 10, the bag opening step 103 is a step of opening the upper end opening of the bag portion. When the process approaches the bag opening step 103, the distance between one mover 22 and the mover 22 immediately after that is shorter than the initial distance when the mover 22 has been applied to the side seal portion 3 immediately after the start end side packaging bag feeding device 50, so that the upper end opening 4*a* is easier to open. Next, the guide spatula 60 of the bag opening device 14 is inserted into the upper end opening 4*a* from above. The guide spatula 60 inserted into the bag portion 4 is separated so that the tip portions are opposite to each other, and pushes the upper end opening 4*a* apart. At this time, the distance between one mover 22 and the mover 22 immediately after that may be further shortened. As a result, the upper end opening 4*a* can be greatly expanded.

Then, the guide spatula 60 is raised to be pulled out from the bag portion 4, and is returned to the initial position along the first circulation path. On the other hand, one mover 22 and the mover 22 immediately after that hold the side seal portion 3 so as to maintain the open state of the upper end opening 4*a*, and move to the next filling step 104.

As shown in FIGS. 9 and 10, the filling step 104 is a step of filling the bag portion 4 with the object to be packaged. The distance between one mover 22 and the mover 22 immediately after that is maintained at a value in an open state in which the upper end opening 4*a* is expanded in the bag opening step 103. Next, the filling nozzle 65 is inserted into the opened upper end opening 4*a*, a shutter 68*b* of a stocker 68 is opened, and a predetermined amount of the object to be packaged is stored in the bag portion 4. Then, a lower pipe 67*b* of the degassing unit is pushed from the upper side of the filling nozzle 65 toward the lower bag portion 4. After the object to be packaged is pushed into the bag portion 4 with the pipe tip portion 67*c* and filled, the inside of the bag portion 4 becomes a small hole 67*d* of the pipe tip portion 67*c*. The inside of the bag portion 4 is degassed from the small hole 65*c* of the filling nozzle 65. When the degassing is completed, the lower pipe 67*b* and the filling nozzle 65 are pulled out from the bag portion 4, the distance between one mover 22 and the mover 22 immediately after that is increased, and the upper end opening 4*a* is closed. One mover 22 and the mover 22 immediately after that hold the side seal portion 3 so as to maintain the closed state of the upper end opening 4*a*, and move to the next gas replacement step 105.

As shown in FIGS. 9 and 10, the gas replacement step 105 is a step of replacing the air in the bag portion 4 with an inert gas. In the gas replacement step 105, as shown in step (5) of FIG. 10, first, a temporary sealing step of temporarily sealing the upper end opening 4*a* maintained in the closed state by one mover 22 and the mover 22 immediately after that is performed. In the temporary sealing step, the upper end opening 4*a* is heat-sealed from the front and rear ends of the side sealing portion 3 in front of the bag portion 4 related to one mover 22 and the bag portion 4 behind the bag portion 4 related to the mover 22 immediately after that. The temporary sealing step is a step of heat-sealing a predetermined range toward the center. As a result, an unsealed portion is left in the vicinity of the center of the upper end opening 4*a*. A small hole into which the gas nozzle 70 can be inserted can be formed. After that, as shown in step (6) of the figure, a gas replacement process is performed in which the gas nozzle 70 is inserted into the hole and the inside of the bag portion 4 is replaced with the inert gas. Since the upper end opening 4*a* is narrowed down to form a small hole by the temporary sealing step, the amount of the inert gas leaking from the bag portion 4 during the gas replacement can be reduced. Furthermore, as shown in FIG. 9, in the gas replacement step 105, the distance parallel to the conveying path 13 is set to be relatively long as compared with the other processing steps, so that the bag portion 4 takes longer than the other processing steps, with the result that inside air can be replaced with gas. When the gas replacement is completed and the gas nozzle is pulled out from the bag portion 4, the distance between one mover 22 and the mover 22 immediately after that is increased, and the small hole formed in the upper end opening 4*a* is closed. While maintaining this closed state, the bag portion is moved to the next sealing step 106 while maintaining the closed state.

As shown in FIGS. 9 and 10, the sealing step 106 is a step of heat-sealing and sealing the upper end opening 4*a*. As shown in FIG. 9, the second grips 25 are configured to release the side seal portion 3 when the sealing step 106 is completed. As shown in FIG. 9, the mover 22 related to the second grips 25 separated from the side seal portion 3 travels linearly on the orbit along the guide rail 21 and is sent out from the start end side packaging bag feeding device 50. The side seal portion 3 is gripped and is configured to participate in the next packaging process.

Furthermore, as shown in FIG. 10, after the upper end opening 4*a* has been heat-sealed in the sealing step 106, an inspection step of measuring the gas concentration in the sealed bag portion is subsequently performed. As shown in FIG. 10, a gas concentration measuring device 106*a* is a laser type gas concentration measuring device, which irradiates a gas in the bag portion 4 with laser light in a predetermined band and is based on the absorbance of the laser light. The gas concentration of the oxidizing gas mixed in the inert gas in the bag portion 4 is measured. Thereby, it is possible to detect and measure whether or not the gas replacement has been normally performed. The packaging bag series 5 that has completed the sealing step 106 is moved to the next perforation step 107 along the conveying direction.

As shown in FIGS. 9 and 10, the perforation step 107 is a step of processing a cut line composed of a dotted perforation on the side seal portion 3. When the side seal portion 3 of the packaging bag series 5 sent out from the terminal packaging bag feeder 55 along the conveying direction is located between the perforation blade portion 83 and the blade contact portion 84 of the perforation cutter device 80. The perforated blade portion 83 and the blade contact portion 84 sandwich the side seal portion 3, and the side seal portion 3 is engraved with a dotted line from the upper end opening 4*a* side toward the lower side of the bag portion 4. As a result, the bag portions 4 can be easily separated from the packaging bag series 5 one by one.

After the perforation step 106 described above, the tip end portion of the packaging bag series 5 is gripped by the first grip 40 of the transport device 12, and is pulled and conveyed along the conveying direction, as shown in FIG. 10. Then, in the cutting step 108, as shown in FIGS. 9 and 10, after the conveying device 12 pulls and transports a predetermined portion of the packaging bag series 5, the side seal portion 3 is separated by the cutting cutter device 81. As a result, a bag product can be formed which is obtained by separating a predetermined bag portion 4 from continuous packaging of packaging bags based on the film 1. The bag product according to the present embodiment includes, for example, a single package series having one bag portion 4, a double package series having two bag portion, and a triple package series having three bag portions. The single to triple bag products separated from the packaging bag series 5 are carried out by the carry-out slide 42 and the carry-out conveyor 44 as shown in FIG. 9 or FIG. 1. At this time, the bag product related to the defective seal of the side seal portion 3 or the upper end opening 4*a*, or the bag product related to the defective gas concentration of the inert gas in the previous inspection step is discarded to the outside of the carry-out slide 42 by the sorter 43.

Furthermore, instead of being configured to pull and convey the packaging bag series 5 with the first grips 40 of the conveying device 12 shown in FIG. 10, for example, a winding device having a rotating drum to which a winding core is attached is used. The tip of the packaging bag series 5 may be wound around a winding core, and then the packaging bag series 5 may be wound while being pulled by a rotating drum.

According to the packaging system 10 of the present embodiment, each mover of the bag mouth opening/closing device 20 is independently controlled to stop and move while finely detecting the position on the guide rail 21 by linear drive. As a result, even when the distance between the adjacent side seal portions 3 of the packaging bag series that moves along the conveying direction changes, the change can be easily dealt with.

Furthermore, the guide rail 21 of the bag mouth opening/closing device 20 can be moved in the up-down direction. As a result, even when the width of the film 1 is changed and the height of the packaging bag series 5 is changed, the changes of the width of the film 1 and the height of the packaging bag series 5 can be easily dealt with.

Furthermore, according to the packaging system 10 of the present embodiment, the bag mouth opening/closing device with the movers 22 for opening or closing the upper end openings 4*a* of the bag portions 4 is provided in parallel with the conveying path 13 for conveying the continuous packaging bag series 5 made of the long film 1. As a result, since both ends of the packaging bag supplied one by one are gripped by the grip pair, and the distance between the paired grips is changed to open and close the bag mouth to fill the packaging bag with the object, the configuration of the entire system can be simplified as compared with the conventional packaging machine that replaces gas. Consequently, the equipment can be easily adjusted and maintained, and the bag product can be easily adjusted according to the intended use.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A packaging system comprising:

a bag feeding device widthwise folding a long film unwound from a film roll to form a plurality of side seal portions for partitioning the folded long film at predetermined intervals along a length direction, the bag feeding device forming a plurality of bag portions between the adjacent side seal portions, the bag portions having respective upper end openings, the bag feeding device further forming a series of packaging bags from the long film, the packaging bag series including a plurality of successive bag portions;

a conveying device for pulling and conveying the packaging bag series supplied from the bag feeding device along a conveying path to a counter-bag-feeding-device side with a first grip, the packaging system opening the upper end openings of the bag portions on the conveying path to fill each bag portion with an object to be packaged, replacing an atmosphere inside each bag portion with a predetermined inert gas, and then sealing each bag portion;

a guide rail parallel to the conveying path;

a plurality of movers respectively having second grips holding the side seal portions and being run on the guide rail, one of each mover and the guide rail being provided with a permanent magnet, and the other being provided with an electromagnet;

a drive unit which moves the movers independently of each other on the guide rail in a linear drive manner;

a mover position control unit which detects a position of each mover on the guide rail and stops each mover at a predetermined position; and a bag mouth opening/closing device which is configured to open or close an upper end opening of each bag portion by controlling stop positions of one of the movers and the mover immediately after said one of the movers to adjust a distance between the side seal portions of said one of the movers and the mover immediately after said one of the movers.

2. The system according to claim 1, wherein the conveying path is formed in a linear line shape, and the guide rail has an orbit including a linear part facing the conveying path.

3. The system according to claim 2, wherein the orbit is configured to be shiftable in an up-down direction relative to the conveying path.

4. The system according to claim 1, further comprising a starting end side packaging bag feeding device provided on a starting end side of the conveying path for sending the packaging bag series from the bag feeding device along the conveying direction, and a terminal side packaging bag feeding device provided at a terminal side of the conveying path for delivering the packaging bag series to the conveying device along the conveying direction, the starting end side packaging bag feeding device and the terminal side packaging bag feeding device assisting conveyance of the packaging bag series along the conveying path.

5. The system according to claim 1, further comprising:

a bag opening device for opening the upper end opening of each bag portion, the bag opening device being provided with a guide spatula;

a filling device for filling each bag portion with the object to be packaged, the filling device being provided with a filling nozzle which is inserted into the upper end opening opened by the bag opening device to feed the object into each bag portion;

a gas replacement device for replacing an atmosphere inside each packaging bag with the inert gas, the gas replacement device including a gas nozzle that is inserted into the upper end opening to feed the inert gas; and a sealing device for closing the upper end opening to seal the packaging bag, the bag opening device, the filling device, the gas replacement device, and the sealing device being arranged sequentially along the conveying path from an upstream side in the conveying direction.

6. The system according to claim 1, further comprising a cut line forming device provided in the vicinity of the conveying device for forming a dotted cut line at a predetermined position on each side seal portion of the continuous packaging bag, and a cutting device provided in the vicinity of the conveying device and including a cutter for separating the packaging bag series at a predetermined number of bag portions.

* * * * *